US011433524B2

(12) United States Patent
Westinghouse

(10) Patent No.: US 11,433,524 B2
(45) Date of Patent: Sep. 6, 2022

(54) VIBRATION REDUCING EXTENSION SYSTEM

(71) Applicant: George E. Westinghouse, South Lake Tahoe, CA (US)

(72) Inventor: George E. Westinghouse, South Lake Tahoe, CA (US)

( * ) Notice: Subject to any disclaimer, the term of this patent is extended or adjusted under 35 U.S.C. 154(b) by 86 days.

(21) Appl. No.: 16/719,676

(22) Filed: Dec. 18, 2019

(65) Prior Publication Data

US 2020/0198113 A1 Jun. 25, 2020

Related U.S. Application Data

(60) Provisional application No. 62/781,833, filed on Dec. 19, 2018, provisional application No. 62/844,226, filed on May 7, 2019.

(51) Int. Cl.

| | |
|---|---|
| ***B25F 5/02*** | (2006.01) |
| ***B25D 17/04*** | (2006.01) |
| ***B25F 5/00*** | (2006.01) |

(52) U.S. Cl.

CPC ..... *B25F 5/006* (2013.01); *B25D 17/04* (2013.01)

(58) Field of Classification Search

CPC ..... B24B 23/005; B25F 5/02; B25F 5/026; B25D 17/04; B25D 17/043

USPC ..... 16/426, 427, 430, 110.1; 173/162.2

See application file for complete search history.

(56) References Cited

U.S. PATENT DOCUMENTS

| | | | | |
|---|---|---|---|---|
| 3,375,617 | A * | 4/1968 | Kaufman | B24B 23/02 451/359 |
| 4,368,556 | A * | 1/1983 | Wanner | B25F 5/003 451/344 |
| 5,411,238 | A * | 5/1995 | Caron | F16M 13/00 248/664 |
| 5,926,913 | A * | 7/1999 | Hernandez | B25F 5/00 16/427 |
| 5,946,844 | A * | 9/1999 | Stoliar | A01K 97/24 43/17.2 |
| 6,324,728 | B1 * | 12/2001 | Blankenheim | B25F 5/021 16/110.1 |
| 6,375,171 | B1 * | 4/2002 | Zimmermann | B25F 5/006 267/137 |
| 6,558,235 | B2 * | 5/2003 | Berg | B24B 23/005 451/357 |
| 6,793,568 | B2 * | 9/2004 | Dotta | B24B 23/03 451/357 |
| 6,901,695 | B2 * | 6/2005 | Lindroth | A01G 3/08 30/290 |
| 6,904,687 | B1 * | 6/2005 | Hill, Sr. | B27B 17/00 30/296.1 |

(Continued)

*Primary Examiner* — Gloria R Weeks
(74) *Attorney, Agent, or Firm* — David Millers

(57) ABSTRACT

A system for attaching a handle such as an extension pole to a power tool such as a hand sander includes a collar, a pressure plate, front and back pairs of vibration absorbing spacers, and a handle holder. The collar has a contact area and two projections extending from the contact area, and the a plate fits onto the projections so that the plate and the contact area of the collar define a space for mounting of a tool. The handle holder extends between the projections and is between the first and second pair of vibration absorbing spacers. A tightening structure may press the plate toward the contact area and compress the first and second pairs of vibration absorbing spacers toward the handle holder.

11 Claims, 5 Drawing Sheets

(56) References Cited

U.S. PATENT DOCUMENTS 7,093,366 B2 * 8/2006 Black ..... A01G 3/053 16/427
8,032,990 B2 * 10/2011 Shinma ..... B25F 5/026 16/426
8,206,200 B2 * 6/2012 Stott ..... F16B 7/0433 451/344
8,256,528 B2 * 9/2012 Oesterle ..... B25F 5/026 173/162.2
8,621,719 B2 * 1/2014 Nakashima ..... B25F 5/006 16/422
8,914,947 B2 * 12/2014 Weiss ..... B25D 17/043 16/431
9,061,412 B2 * 6/2015 Hahn ..... B25F 5/003
9,931,701 B1 * 4/2018 Klein ..... B25H 1/0021
10,537,984 B2 * 1/2020 Steingruber ..... B25F 5/006
2003/0066161 A1 * 4/2003 Wittschen ..... B29C 48/022 16/2.1
2005/0087353 A1 * 4/2005 Oki ..... B25F 5/006 173/162.2
2007/0151074 A1 * 7/2007 Whiteman ..... E04F 21/242 16/110.1
2010/0064480 A1 * 3/2010 Martin ..... B25F 5/026 16/426
2010/0282484 A1 * 11/2010 Moessnang ..... B25F 5/026 173/162.2
2012/0312572 A1 * 12/2012 Nemetz ..... B25F 5/026 173/162.2
2016/0108987 A1 * 4/2016 Williamson ..... A47L 11/4072 15/98
2016/0114472 A1 * 4/2016 Holubarsch ..... B25F 5/026 16/426
2018/0345441 A1 * 12/2018 Nix ..... B25F 5/02
2018/0345442 A1 12/2018 Nix et al.

* cited by examiner

VIBRATION REDUCING EXTENSION SYSTEM

CROSS-REFERENCE TO RELATED APPLICATIONS

This patent document claims benefit of the earlier filing date of U.S. Provisional Pat. App. No. 62/781,833, filed Dec. 19, 2018 and U.S. Provisional Pat. App. No. 62/844,226, filed May 7, 2019, both of which are hereby incorporated by reference in their entirety.

BACKGROUND

Hand held electric sanders are often used in areas that are difficult or unsafe to access. For example, working on a high work area such as the gutters or eaves of a house may require a ladder or similar platform on which an operator can stand. Unfortunately, ladders provide the risk of injury from falling or injury while repositioning the ladders. When refinishing floors, electric sanders are often used in tight spaces such as pantries, closets, stairs and numerous other hard to sand areas, requiring an operator contort or work in an uncomfortable position. Refinishing decks and other exterior home projects also utilize electric sanders, and sometimes sanding these areas requires kneeling or bending for long periods of time which can be painful on an operator's back and knees. Further, handheld electric sanders rely on mechanisms powered by a motor, which typically operates at high RPM and oscillation rates. This operation and the lack of effective systems for reducing vibrations, particularly in orbital sanders, creates vibrations, which can cause irritation and fatigue to an operator's hands and arms when holding the sander. The vibrations may cause injuries or may cause an operator to take frequent breaks from sanding, which results in a loss in productivity. The difficulties using handheld sanders may be worse for people who may have injuries or health conditions that restrict activities. In particular, some people may have vibration sensitive nerve damage in their hands and feet that makes conventional use of a sander difficult.

Systems and methods are needed that make handheld power tools easier and more efficient to use, that reduce vibrations that are inherent to the power tools, and that enable people in a broad range of health conditions to use such tools, particularly handheld electric palm or orbital sanders, which are currently the sander-of-choice for many sanding needs.

SUMMARY

The present invention is in the technical field of power tools and power tool accessories or attachments. More specifically, the present invention is in the technical field of electric sander accessories or attachments.

In one implementation, an attachment or accessory system for a power tool includes a collar that securely attaches to the power tool, for example, an electric palm or orbital sander, and a handle holder that is mounted between two pairs of vibration damping or absorbing spacers. In particular, a front pair of vibration absorbing spacers may be slid onto projections extending from the collar to abut a pressure plate for securing the power tool. The handle holder may be drilled or shaped to slide onto the projections so that a front side of the handle holder abuts the front pair of vibration absorbing spacers, and a back pair of vibration absorbing spacers may be slid onto the extensions to abut the back of the handle holder. A tightening and locking system, e.g., lock nuts, may be attached to the extensions and used to press against the back pair of vibration absorbing spacers and tighten the pressure plate and collar to hold the power tool and to compress the spacers to securely fix the handle holder in place between the two pairs of vibration absorbing spacers. An extension handle may be fit into an adjustable receptacle on the handle holder so that an operator can use a power tool on a high work area that might otherwise require a ladder to reach or use the power tool on a floor or a hard-to-reach work area without being on hands and knees and without being cramped into the hard-to-reach work area. The vibration absorbing spacers may reduce, dampen, or isolate vibrations that might otherwise be transferred from the power tool to the operator through the handle.

BRIEF DESCRIPTION OF THE DRAWINGS

The drawings illustrate examples for the purpose of explanation and are not of the invention itself. Use of the same reference symbols in different figures indicates similar or identical items.

DETAILED DESCRIPTION

Figure 1:
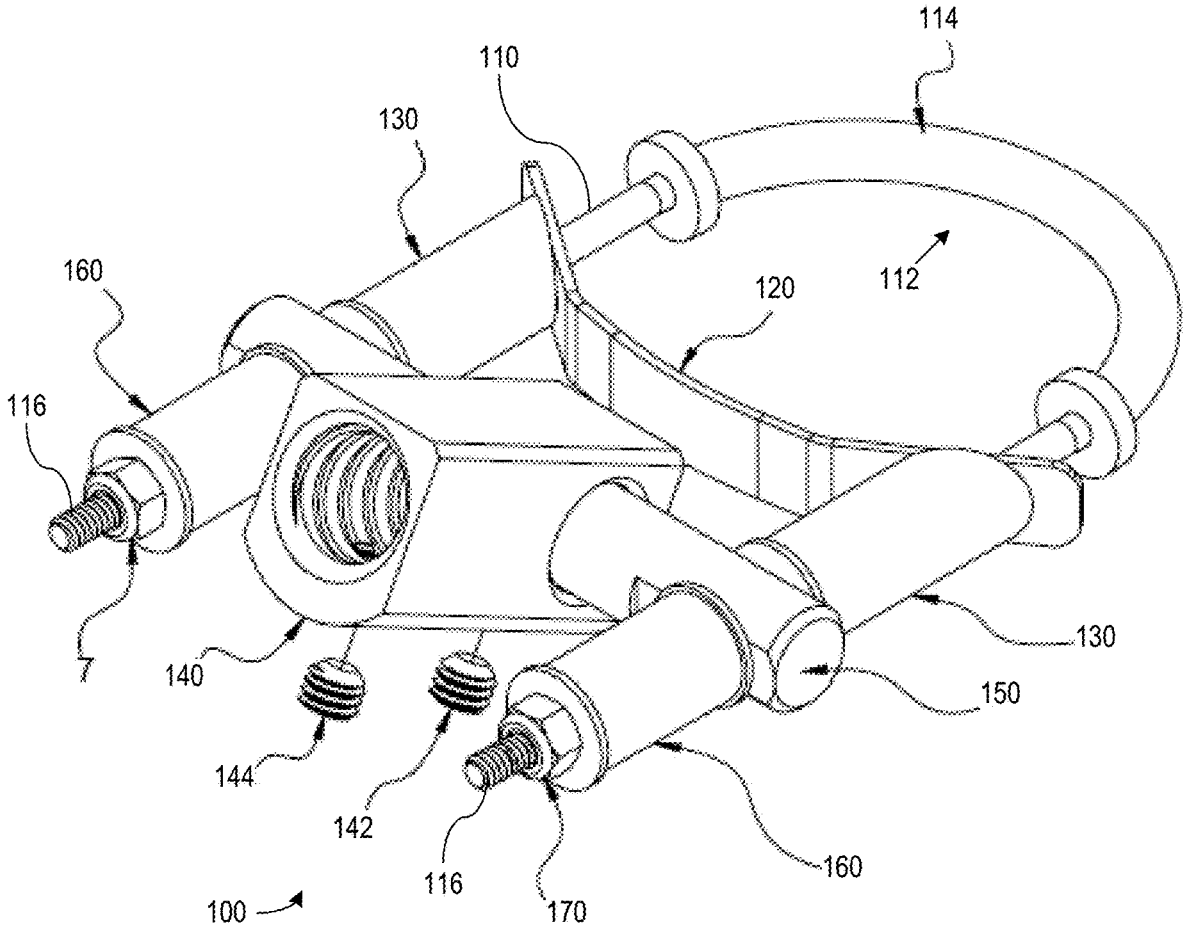
FIG. 1 is a top view of one implementation of a vibration reducing extension system.

An extension system for a hand power tool such as an electric sander allows an operator to attach a handle or extension pole to the power tool and thereby reach high work areas without the need for a ladder and reach work areas at ground level or in tight spaces without requiring the operator to kneel, bend over, or otherwise physically contort in order to reach the work areas. In one implementation, the extension system includes a collar, e.g., a rigid collar, in which a sander may be secured. The collar may be shaped, e.g., U-shaped, to provide a contact area that contacts at least a portion of a power tool and projections extending back from the contact area, and a pressure plate may be fit onto and slid along the projections to contact another portion of the power tool. The collar may allow for 360° relative rotation of the power, so that the power tool may be mounted in the collar facing any desired direction relative to the collar. The collar may further have a handle holder with a handle receptacle for attachment of an extension pole or other handle, and the handle receptacle may be rotatable about the handle holder to adjust an angle of the handle or extension pole relative to the power tool. The handle holder may be mounted between front and back pairs of vibration absorbing spacers that reduce tool vibration transferred from the power tool through the handle or extension pole to the operator. (As used herein, vibration absorbing refers to the ability to absorb, dampen, isolate or otherwise significantly reduce the transmission of vibrations.) In addition, the handle or extension pole attached to the collar may include an on/off switch located near where the operator grips the handle or extension pole, allowing the operator to turn the power tool on or off while the power tool is at the end of the handle or extension pole.

One particular problem that a conventional handle system for power tools needs to solve is holding the power tool with sufficient stability to allow application of a working force without allowing the tool to shift. Suitable stability is particularly difficult to achieve with an extension handle because of the leverage that the handle introduces. As a result, holding a power tool with a flexible strap will generally not be suitable because flexible straps tend to allow the power tools to move too much for efficient use. On the other hand, a very rigid extension handle system may transfer or even amplify the effects of power tool vibrations, which may be a particular problem with tools such as orbital sanders that produce strong vibrations. As disclosed herein, an extension system mounts a handle holder between vibration absorbing spacers. As a result, a power tool such as a sander may be held in a collar with sufficient stability to sustain work required forces, and the vibration absorbing spacers reduce transfer of vibrations to a handle held by an operator.

In accordance with a further aspect of the invention, an extension pole may include a built in power cord with or without an on/off switch, and the extension pole may be fitted to a collar that is able to mount to an electric palm sander for use at a distance. The extension pole and collar may be adjustable to any work surface angle, capable of sanding areas both above and at ground or floor level, while allowing the operator to remain standing on the ground or floor level in a safe and comfortable position without the risk of falling off a ladder or other platform, or the pain of being bent over or kneeling.

Figure 2:
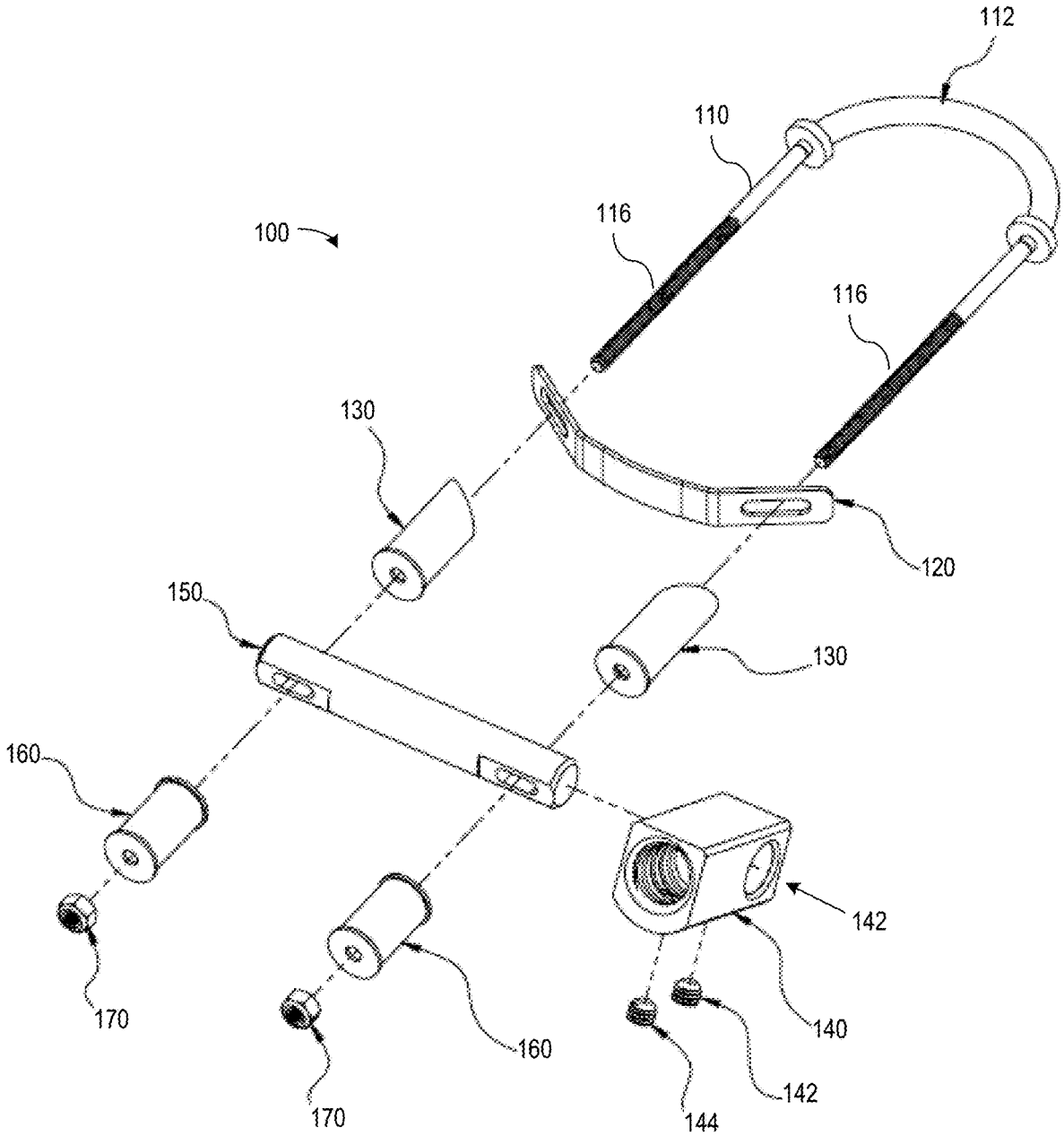
FIG. 2 is an exploded view of the vibration reducing extension system of FIG. 1.

FIGS. 1 and 2 respectively show a mostly assembled view and an exploded view of an extension system 100 in accordance with an exemplary implementation of the present disclosure. Extension system 100 includes a collar 110, which includes a rod, e.g., a piece of ¼" or 5/16" metal rod, that is generally rigid and bent, e.g., into a horseshoe or U-shape. Collar 110 may include a contact area 112 and a pair of projections or protruding ends 116. For example, contact area 112 may correspond to a semicircular portion of collar 110 with a radius of about 2 to 4 inches, and projections 116 may correspond to two straight portions extending out about 3 to 6 inches beyond each end of the semicircular contact area. The dimensions given herein are for an example implementation that is sized for a typical electric handheld sander having a cylindrical portion, e.g., a motor, with a radius of about two to four inches. The shape and dimensions of collar 110 in general may be varied according to the shape and size of a sander or other power tool to be mounted in the extension collar system 100. For example, the curvature or other shape of contact 112 area of collar 110 may roughly match the shape of the power tool to be mounted in the extension collar system.

Contact area 112 of collar 110 may be covered with material 114 that absorbs vibrations, cushions or prevents scratching of a mounted power tool, or better grips the power tool to prevent twisting during operation. In one implementation, collar 110 includes a metal rod and a piece of vibration absorbing tubing, e.g., a 6-inch piece on a 4-inch diameter semicircular portion of the rod, slid over the rod to cover the curved portion of the rod. The tubing may be made of rubber, polyurethane or other flexible material and may have an inner diameter sized to accommodate the rod. Contact area 112 of collar 110 being covered by tubing or other material 114 as described above may be placed adjacent to a part, e.g., the narrowest part, of the power tool, e.g., an orbital sander, and projections 116 of collar 110 may extend back from the power tool. A pressure plate 120, which may be rounded or may have a portion bowing outward from the power tool, may be attached to collar 110 by inserting projections 116 of collar 110 through holes in pressure plate 120. Pressure plate 120 is slid forward until pressure plate 120 meets the electric sander or other power tool to be held. A surface of pressure plate 120 toward the power tool may be partly or fully covered with a material that is vibration absorbing or that prevents scratching of the power tool. Collar 110 and pressure plate 120 when pushed together may enclose an area corresponding to an approximate circle or an oblong oval sized to fit on a section of a power tool, and the two straight projections 116 of collar 110 extend outward from the rear of the enclosed area.

A first or front pair of vibration absorbing spacers 130 are inserted onto respective projections of collar 110 and are pushed forward until spacers 130 meet the back of pressure plate 120. Each spacer 130 may have a one-piece or multi-piece structure. For example, one implementation of a one-piece vibration absorbing spacer includes a tube of vibration absorbing material such as hard rubber or visco-elastic polymer a high damping coefficient. Metal washers may or may not be integrated or attached to the ends of the vibration absorbing tube of each vibration absorbing spacer 130. Alternatively, a multi-piece vibration absorbing spacer 130 may include a vibration reducing bushing about ¼" to ⅜" thick and made of rubber or other vibrations absorbing material, a lock washers inserted onto the projection and pushed forward until the lock washer meets the vibration-reducing bushing, and a tube spacer inserted onto a projection and pushed forward until the tube spacer meet respective lock washers. The tube spacers may be made of a durable plastic such as nylon or a metal such as aluminum and may be about ¾" long. The length of each vibration absorbing spacer 130 may be selected or varied in different implementations to control an offset or space between a mounted power tool and a location where a handle attaches to extension system 100.

A handle holder 150 slides onto projections 116 of collar 110, so that portions of handle holder 150 near opposite ends of handle holder 150 abut back ends of the front pair of vibration absorbing spacers 130. Handle holder 150 may be made of metal or other durable material and has a generally cylindrical in shape with two holes through the side of the cylindrical shape where the projections 116 of collar 110 fit through handle holder 150. Flat areas may be provided around both of the through-holes so that flat ends of vibration absorbing spacers 130 and 160 abut flat areas of handle holder 150. Alternatively, ends of vibration absorbing spacers 130 and 160 may shaped, e.g., curved, to better contact curved surfaces of handle holder 150.

A second or back pair of vibration absorbing spacers 160 are inserted onto respective projections 116 of collar 110 and are pushed forward until spacers 160 abut handle holder 150. Each spacer 160 may have a one-piece or multi-piece structure similar or identical to the structure of each front spacer 130. Spacers 160 may, however, be shorter than spacers 130 since the length of spacers 130 controls the spacing between the mounted power tool and a handle attached to handle holder 150, and the length of spacer 160 may be chosen for desired vibration absorbing, dampening, or isolating characteristics. One implementation of a one-piece vibration absorbing spacer 160 includes a tube of vibration absorbing material such as hard rubber or visco-elastic polymer with or without metal washers integrated or attached to the ends of the vibration absorbing tube. Alternatively, a multi-piece vibration absorbing spacer 160 may include flat or curved font washer shaped to abut a flat or curved surface of handle holder 150, a first vibration absorbing bushing abutting front washer, a back washer, and a second vibration absorbing bushing abutting the back washer.

A tightening structure 170 attaches to projections 160 of collar 110 to tighten collar 110 on a power tool and to fix handle holder 150 in place. In the illustrated implementation of FIGS. 1 and 2, the ends of projections 116 of collar 110 have threading, and tightening structure 170 include lock nuts threaded onto projections 116. The lock nuts may be wing nuts or may be tightened with a wrench or other tool to compress vibration absorbing spacers 130 and 160 and press pressure plate 120 against the mounted power tool. Alternatively, tightening structure 170 may permit tightening at multiple locations along projections 116 of collar 110. For example, a first set of nuts or other tightening elements directly behind pressure plate 120 may be used to press pressure plate 120 against the power tool, and a second set of nuts or other tightening elements may be used to compress vibration absorbing spacers 130 and 160 to fix handle holder 150 in place and control the pliability of spacers 130 and 160.

Handle holder 150, in the assembled extension handle system 100, is mounted on projections 116 of collar 110 between the front pair of vibration absorbing spacers 130 and the back pair of vibration absorbing spacers 160. The front pair of vibration absorbing spacers 130 absorb, dampen, or isolate vibrations that might otherwise be conducted from pressure plate 120 to handle holder 150. The back pair of vibration absorbing spacers 160 absorb, dampen, or isolate vibrations that might otherwise be conducted from tightening structure 170 to handle holder 150. Handle holder 150 is thus well protected from vibrations that a power tool mounted in system 100 may produce.

A movable handle receptacle 140 is attached to, e.g., is slid onto, handle holder 150 before handle holder 150 is slid onto the projections of collar 110. Handle receptacle 140 in particular has a cylindrical bore 146 that may be sized to slide on a cylindrical portion of handle holder 150. Handle receptacle 140 may be rotated about the length axis of handle holder 150 to achieve a desired pitch angle between the tool mounted in collar 110 and a handle or extension pole screwed into handle receptacle 140. A set screw 142 may be tightened to fix handle receptacle 140 on handle holder 150 and keep a handle or extension pole coupled to handle receptacle 140 at a fixed angle relative to the power tool mounted in collar 110.

Figure 3:
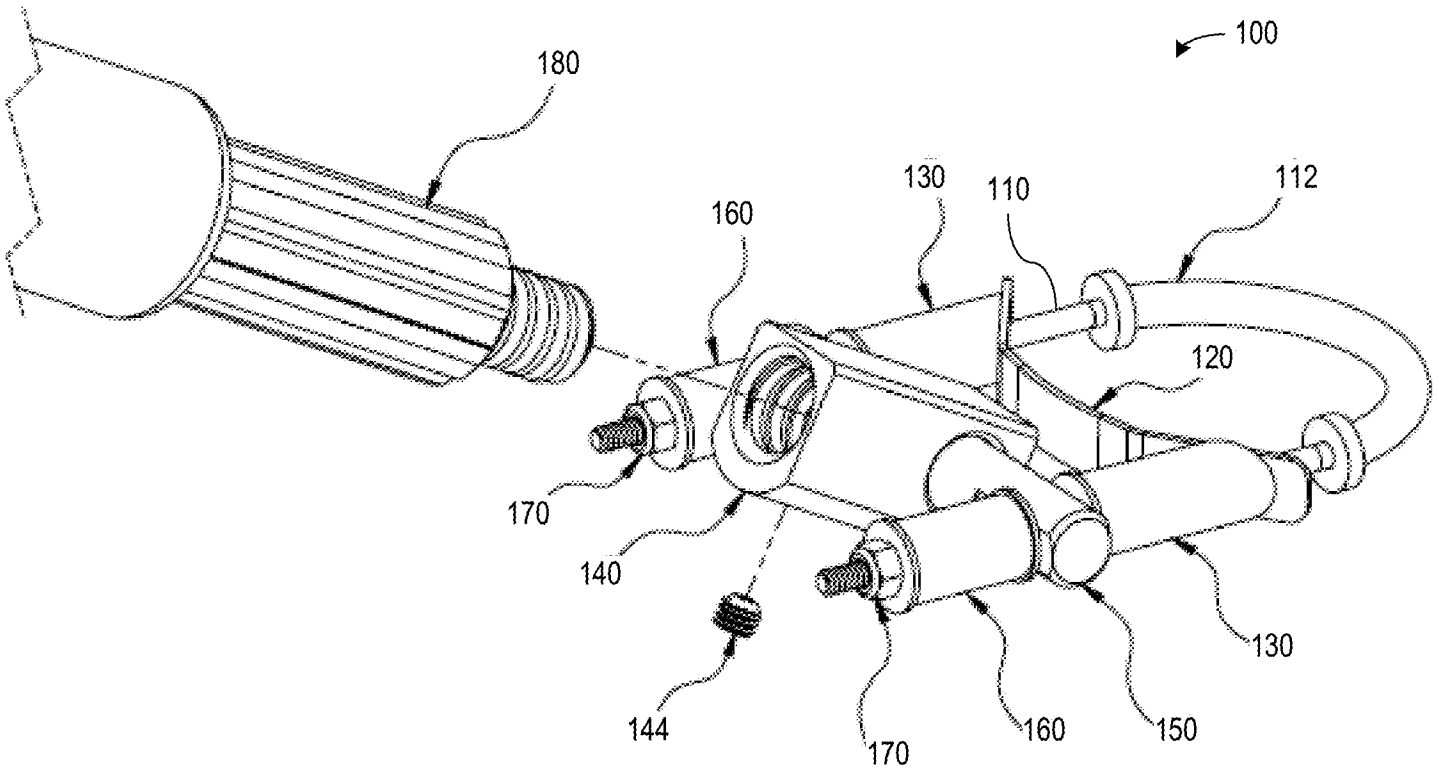
FIG. 3 illustrates how an extension handle may engage a vibration reducing extension system.

FIG. 3 shows a threaded end of an extension pole or other handle 180 that may be screwed into handle receptacle 140. Extension pole or handle 180 may, for example, have a male acme threaded end that may be affixed in a female acme threaded fixture of handle receptacle 140. A second set screw 144 in handle receptacle 140 may be loose when screwing or unscrewing extension pole or handle 180 and may be tightened to prevent handle 180 (once threaded into handle receptacle 140) from coming loose and to prevent the extension collar system from rotating about the length of handle 180. Various handles of different shapes and lengths can be used to fit on handle receptacle 140 as needed for the particular height, size, or configuration of a work area. For example, longer extension poles may be used to reach a higher work areas. In some examples, the handle may include an integrated power cord with an electrical outlet into which the mounted power tool may be connected and may include a switch at a convenient location to enable an operator holding handle 180 to turn on or turn off the power to the power tool in system 100.

Figure 4:
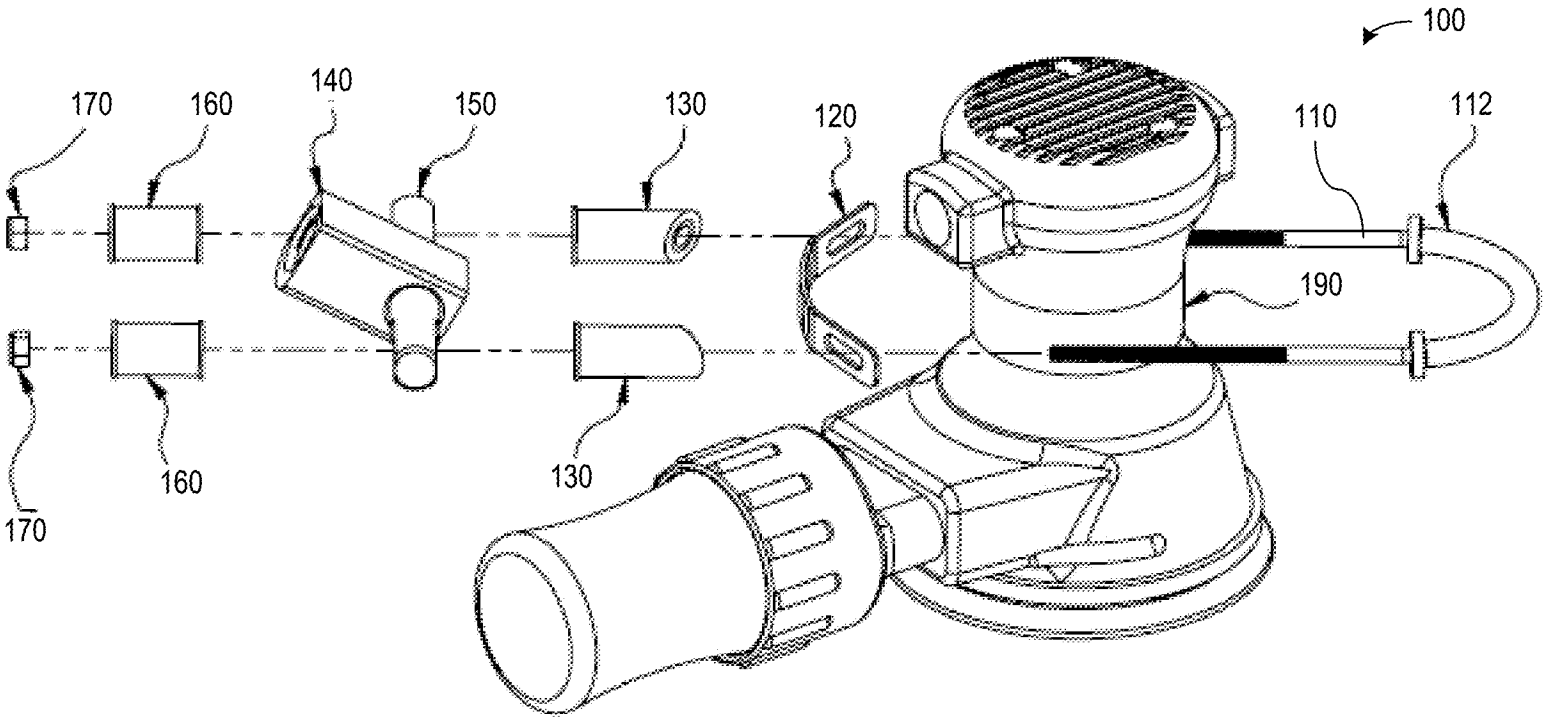
FIG. 4 illustrates how a hand power tool may engage a vibration reducing extension system.
Figure 5:
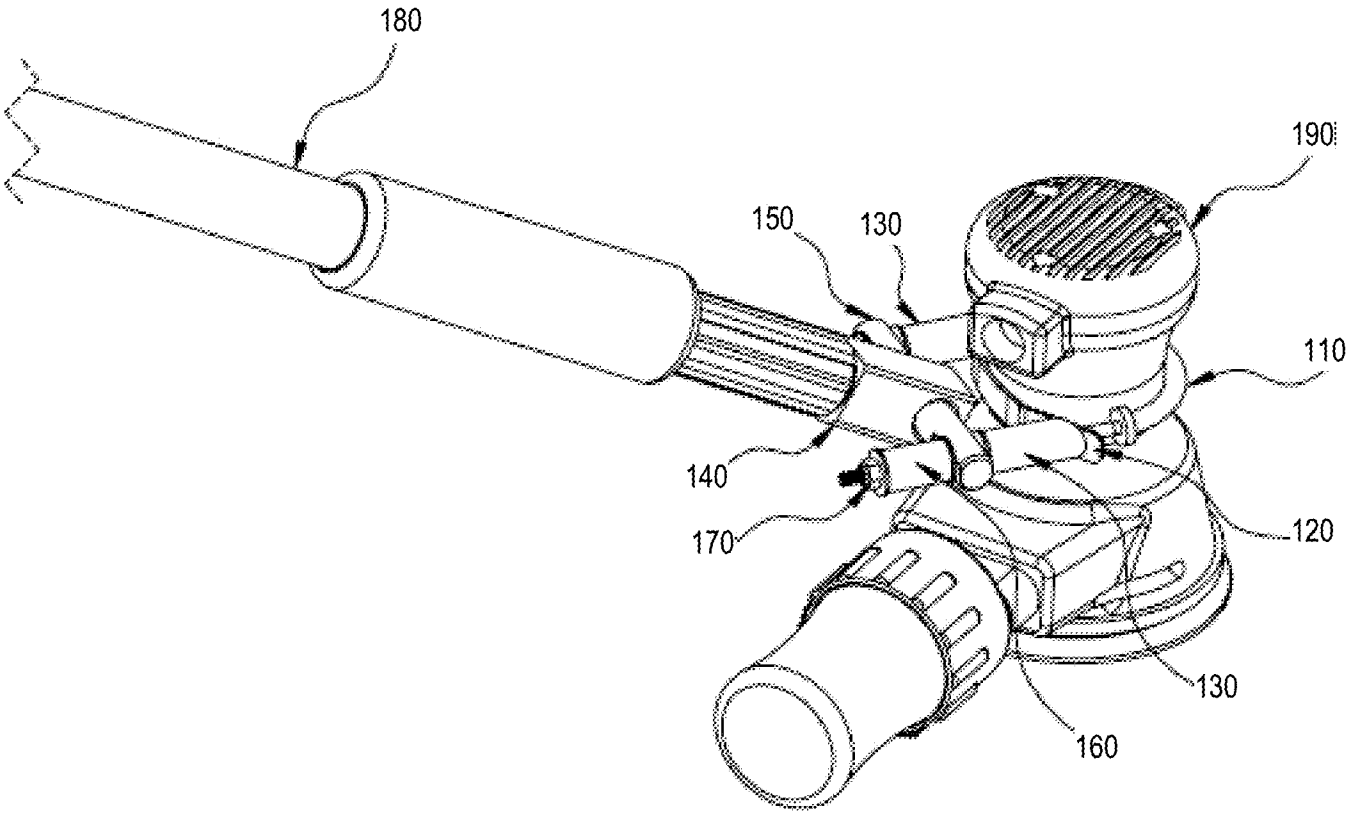
FIG. 5 shows a vibration reducing extension system with a power tool and an extension handle attached.

FIG. 4 illustrates the example in which a hand sander 190, e.g., an orbital sander, may be mounted in extension system 100. Handheld orbital sanders are currently the sander of choice for many sanding needs, particularly where larger and more aggressive sanding tools fail to provide a desired level of control of sanding. As shown, a relatively narrow portion, e.g., a portion containing an electrical motor, of sander 190 fits between collar 110 and pressure plate 120. FIG. 4 shows one specific orientation of sander 190 relative to collar 110, but hand sander 190 may be rotated as desired to control a roll angle of hand sander 190 relative to system 100. When pressure plate 120, front vibration absorbing spacers 130, handle holder 150, and back vibration absorbing spacers 160 are slid on to projections 116 of collar 110, tightening structure 170, e.g., lock nuts, may be tightened until pressure plate 120 presses on hand sander 190 to rigidly fix sander 190 relative to collar 110. That tightening also compresses both pairs of vibration absorbing spacers 130 and 160 to fix handle holder 150 but still allow vibration absorbing spacers 130 and 160 to reduce or prevent transfer of vibrations from hand sander 190 to an operator holding a handle attached to handle receptacle 140 on handle holder 150. FIG. 5 illustrates the fully assembled system with an extension pole or handle 180 screwed into handle receptacle 140, and sander 190 held in collar 110.

Although particular implementations have been disclosed, these implementations are only examples and should not be taken as limitations. Various adaptations and combinations of features of the implementations disclosed are within the scope of the following claims.

What is claimed is:

1. A system for attaching a handle to a power tool that is configured for handheld use, the system comprising:

a collar having a contact area and two projections extending from the contact area;

a plate that fits onto the projections, the plate and the contact area of the collar defining a space in which the power tool fits and is held against the contact area during use, the plate being movable along the projections;

a first pair of vibration absorbing spacers respectively on the projections and adjacent to the plate;

a handle holder on the projections and adjacent to the first pair of vibration absorbing spacers, the handle holder extending between the projections;

a second pair of vibration absorbing spacers respectively on the projections and adjacent to the handle holder; and tightening structure configured to press the plate toward the contact area of the collar and compress the first and second pairs of vibration absorbing spacers against the handle holder, the tightening structure being configured to move the plate along the projections and into contact with the power tool during use of the power tool.

2. The system of claim 1, wherein the collar comprises a rod that is U-shape, the contact area including a curved portion of the rod and the projections extending from the curved portion of the rod.

3. The system of claim 2, further comprising a compliant material on the curved portion of the rod.

4. The system of claim 2, wherein the projections have threading, and the tightening structure includes nuts that are threaded onto the threading.

5. The system of claim 1, further comprising a handle receptacle on the handle holder, the handle receptacle including a fixture for attachment of an extension pole.

6. The system of claim 5, further comprising the extension pole.

7. The system of claim 1, wherein the space defined by the collar and the plate is shaped to contact and hold a hand sander.

8. The system of claim 1, wherein the space defined by the collar and the plate is shaped to contact and hold an orbital sander.

9. The system of claim 1, wherein the handle holder comprises a metal cylinder with first and second holes extending through the metal cylinder adjacent respectively to first and second ends of the metal cylinder.

10. A system for attaching a handle to a power tool that is configured for handheld use, the system comprising:

a collar having a contact area and two projections extending from the contact area;

a plate that fits onto the projections, the plate and the contact area of the collar defining a space in which the power tool fits and is held against the contact area during use;

a first pair of vibration absorbing spacers respectively on the projections and adjacent to the plate;

a handle holder on the projections and adjacent to the first pair of vibration absorbing spacers, the handle holder extending between the projections, wherein the handle holder comprises a metal cylinder with first and second holes extending through the metal cylinder adjacent respectively to first and second ends of the metal cylinder, and where the metal cylinder includes flat areas around the first and second holes, the flat areas contacting the first pair of vibration absorbing spacers;

a second pair of vibration absorbing spacers respectively on the projections and adjacent to the handle holder; and tightening structure configured to press the plate toward the contact area of the collar and compress the first and second pairs of vibration absorbing spacers against the handle holder.

11. The system of claim 1, wherein the handle holder is between the first pair of vibration absorbing spacers and the second pair of vibration absorbing spacers.

* * * * *